US006355213B1

(12) United States Patent
Takasaki et al.

(10) Patent No.: US 6,355,213 B1
(45) Date of Patent: Mar. 12, 2002

(54) ALUMINUM DIE-CAST MATERIAL FOR BOATS

(75) Inventors: Norimasa Takasaki; Hiroyuki Murata; Yoshiyuki Matsuda, all of Wako; Nobuhiro Ishizaka, Tokyo, all of (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/653,907

(22) Filed: Sep. 1, 2000

(30) Foreign Application Priority Data

Sep. 3, 1999 (JP) ..... 11-250939

(51) Int. Cl.[7] ..... C22C 21/02
(52) U.S. Cl. ..... 420/546; 420/549
(58) Field of Search ..... 420/542, 546, 420/548, 549

(56) References Cited

U.S. PATENT DOCUMENTS 3,771,214 A * 11/1973 Binger et al. ..... 29/488
3,881,879 A * 5/1975 Singleton, Jr. et al. ..... 29/193
3,963,453 A * 6/1976 Singleton, Jr. ..... 29/197.5
5,234,759 A * 8/1993 Inabayashi et al. ..... 428/330
5,523,050 A * 6/1996 Lloyd et al. ..... 420/528

FOREIGN PATENT DOCUMENTS

JP 2250997 10/1990

* cited by examiner

*Primary Examiner*—George Wyszomierski
*Assistant Examiner*—Janelle Combs-Morillo
(74) *Attorney, Agent, or Firm*—Adams & Wilks

(57) ABSTRACT

A novel aluminum die-cast material having all good properties of high fluidity, good corrosion resistance and high mechanical strength is disclosed. As its Mg content, a factor to increase mechanical strength, is increased to fall between 0.4 and 0.6% by weight, the material has good mechanical properties. As its Cu content, a factor to cause corrosion, is reduced to at most 0.15% by weight, the material has good corrosion resistance to seawater. As its Si content, a factor to increase casting fluidity, is increased to fall between 10.0 and 11.5% by weight, the material has good fluidity.

11 Claims, 2 Drawing Sheets

ALUMINUM DIE-CAST MATERIAL FOR BOATS

BACKGROUND OF THE INVENTION

1. Field of the Invention

The present invention relates to an aluminum die-cast material for boat equipment generally required to have seawater corrosion resistance and mechanical strength, especially for outboard and inboard propelling apparatuses of boats and water-jet pumps and other members constituting parts of boat bottoms.

2. Description of the Related Art

The recent tendency in the art is toward weight-reduced boat equipment, for which are being much used aluminum die-cast materials. Some aluminum die-cast materials are defined in JIS H-5302 (1990) "Aluminum Alloy Die-Casts", including ADC1 (Cu: at most 1.0% by weight), ADC3 (Cu: at most 0.6% by weight), ADC5 (Cu: at most 0.2% by weight), ADC6 (Cu: at most 0.1% by weight), ADC10, 10Z (Cu: 2 to 4% by weight), ADC12, 12Z (Cu: 1.5 to 3.5% by weight), and ADC14 (Cu: 4 to 5% by weight).

The constituent Cu in such aluminum die-cast materials is a primary cause of rust. Therefore, the Cu content of aluminum die-cast materials for boats must be at most 0.6% by weight for their seawater corrosion resistance. ADC3 (Cu: at most 0.6% by weight), ADC5 (Cu: at most 0.2% by weight) and ADC6 (Cu: at most 0.1% by weight) will meet the requirement.

On the other hand, the fluidity of melts of such die-cast materials is another important factor for smoothly die-casting them. The fluidity of their melts essentially depends on the constituent Si therein. In this respect, the three materials of ADC3 (Si: 9 to 10% by weight), ADC5 (Si: at most 0.3% by weight) and ADC6 (Si: at most 1.0% by weight) are discussed. Their fluidity is in the order of ADC5<ADC6<ADC3. That is, the fluidity of melts of ADC5 and ADC6 is not so high.

ADC3 could have good fluidity and good corrosion resistance but its mechanical strength is lower than that of ADC12.

SUMMARY OF THE INVENTION

The present invention has been achieved with the above matters taken into consideration, and its object is therefore to provide a novel aluminum die-cast material that satisfies all the requirements of fluidity, corrosion resistance and mechanical strength.

According to an aspect of the present invention, there is provided an aluminum die-cast material for boats, which consists essentially of 0.15% by weight or less of Cu (copper), 10.0 to 11.5% by weight of Si (silicon), 1.0 to 2.5% by weight of Mg (magnesium), 0.15% by weight or less of Zn (zinc), 0.7 to 0.9% by weight of Fe (iron), 0.4 to 0.6% by weight of Mn (manganese), 0.1% by weight or less of Ni (nickel) and 0.1% by weight or less of Sn (tin), and the balance of Al (aluminum).

Cu-containing aluminum alloys having a Cu content of larger than 0.6% by weight are seriously corroded with seawater. Therefore, for its seawater corrosion resistance, the Cu content of the aluminum die-cast material of the invention must be limited to at most 0.6% by weight. In case where its Cu content is not larger than 0.15% by weight, the material provides better corrosion resistance. Therefore, the Cu content of the material is preferably at most 0.15% by weight.

For better fluidity in casting, a higher Si content is preferred. For providing fluidity comparable to or higher than that of ADC3 (Si: 9 to 10% by weight) which is said to have good fluidity, the Si content of the material of the invention is limited to at least 10% by weight. However, if larger than 11.5% by weight, too much Si will give primary crystals whereby the material will be brittle and its strength is lowered. Therefore, it is desirable that the Si content of the material falls in a range of 10.0 to 11.5% by weight.

The tensile strength of ADC3 is 245 N/mm$^2$. It is desirable that the tensile strength of the material of the invention is not lower than that of ADC3. When quenched in water, the material having an Mg content of at least 1.0% by weight could have a tensile strength of at least 245 N/mm$^2$, and it is good. However, if larger than 2.5% by weight, it is undesirable since too much Mg will increase the viscosity of molten aluminum (aluminum melt) whereby the fluidity of the aluminum melt is lowered. Accordingly, it is desirable that the Mg content of the material of the invention falls between 1.0 and 2.5% by weight.

Preferably, Zn is not in the material as it lowers the corrosion resistance of Al. However, Zn, if any, in the material will improve the workability of the material and will therefore lower the production costs thereof. Accordingly, the material may contain at most 0.15% by weight of Zn.

An aluminum melt having an Fe content of smaller than 0.7% by weight will stick on the surface of a mold in which it is cast, and therefore cannot be smoothly and continuously cast owing to its negative influence on the mold. Aluminum alloys having an Fe content of larger than 0.9% by weight are brittle and their mechanical properties are poor. Accordingly, it is desirable that the Fe content of the material of the invention falls between 0.7 and 0.9% by weight.

Adding Mn to the material is effective for preventing the negative influence of iron compounds on the material, as Mn forms a tabular intermetallic compound of Al-Mn(Fe)-Si in the material. The intermetallic compound retards the negative influence of Fe on the material, thereby preventing the toughness and the impact resistance of the material from being lowered. If smaller than 0.4% by weight, Mn will be ineffective; but if larger than 0.6% by weight, too much Mn will crystallize to lower the mechanical properties of the material. Accordingly, it is desirable that the Mn content of the material of the invention falls in a range of 0.4 and 0.6% by weight.

Preferably, Ni is not in the material as it seriously lowers the corrosion resistance of Al. However, reducing too much the Ni content of the material is unfavorable as the production costs of the material will increase. In view of the balance between the corrosion resistance and the production costs of the material, it is desirable that the Ni content of the material is at most 0.1% by weight.

Preferably, Sn is not also in the material as it seriously lowers the corrosion resistance of Al. However, reducing too much the Sn content of the material is also unfavorable as the production costs of the material will increase. In view of the balance of the corrosion resistance and the production costs of the material, it is desirable that the Sn content of the material is at most 0.1% by weight.

BRIEF DESCRIPTION OF THE DRAWINGS

Certain preferred embodiments of the present invention are described in detail below, by way of example only, with reference to the accompanying drawings, in which.

DETAILED DESCRIPTION OF THE PREFERRED EMBODIMENTS

The following description is merely exemplary in nature and is in no way intended to limit the invention, its application or uses.

Figure 1:
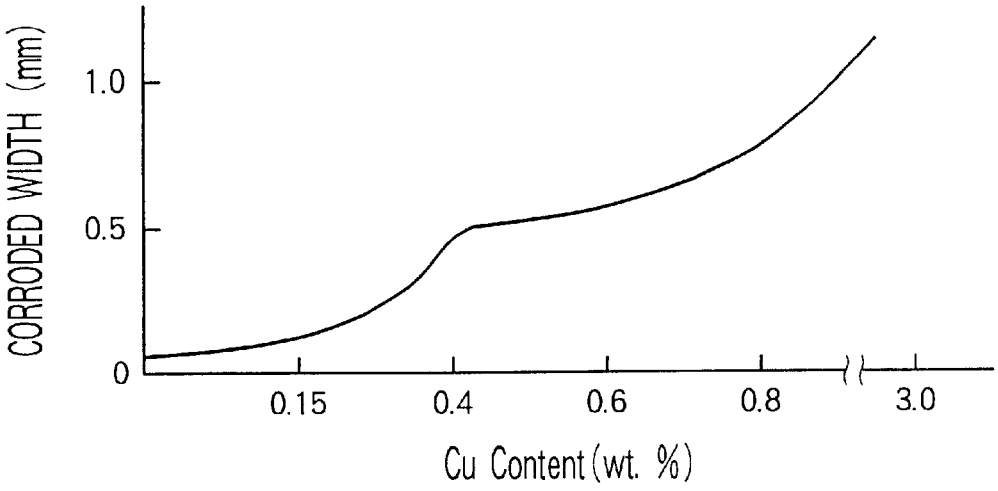
FIG. 1 is a graph showing the seawater corrosion change of an aluminum alloy relative to the varying Cu content thereof.

In the graph of FIG. 1, the horizontal axis indicates the Cu content (% by weight) of an aluminum alloy, and the vertical axis indicates the corroded width (mm) thereof. In case where the Cu content is larger than 0.6% by weight, the corroded width greatly increases. Therefore, the Cu content of the aluminum alloy must be at most 0.6% by weight. In case where the Cu content is not larger than 0.15% by weight, the corroded width is much reduced. For good corrosion resistance to seawater, the Cu content of the aluminum alloy must be at most 0.6% by weight. For better corrosion resistance to seawater, a higher Cu content is preferred. Therefore, in the invention, the Cu content of the material is limited to at most 0.15% by weight.

However, the material containing such a small amount of Cu could not ensure good strength. Therefore, to compensate its strength, a predetermined amount of Mg is added to the material.

Figure 2:
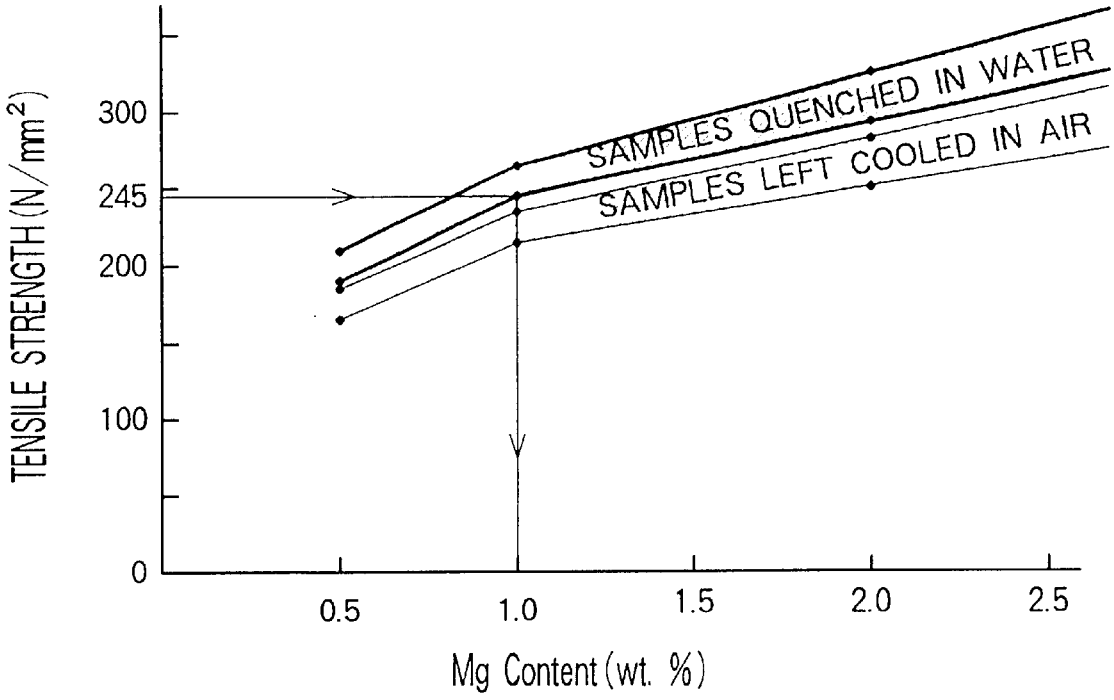
FIG. 2 is a graph showing the relationship between the Mg content and the tensile strength of the aluminum die-cast material for boats of the invention.

FIG. 2 is a graph showing the relationship between the Mg content and the tensile strength of the aluminum die-cast material for boats of the invention. In this, the horizontal axis indicates the Mg content (% by weight) of the material; and the vertical axis indicates the tensile strength ($N/mm^2$) thereof. It is seen therein that the tensile strength of the material increases with the increase in the Mg content thereof.

The tensile strength of ADC3 is 245 $N/mm^2$, and it is desired that the tensile strength of the material of the invention is at least comparable to or higher than that of ADC3. It has been found that, when quenched in water, the material having an Mg content of at least 1.0% by weight satisfies the requirement of its tensile strength to be at least 245 $N/mm^2$. However, if larger than 2.5% by weight, it is undesirable since too much Mg will increase the viscosity of molten aluminum (aluminum melt) whereby the fluidity of the aluminum melt is lowered. Accordingly, the Mg content of the material of the invention is defined to fall between 1.0 and 2.5% by weight.

Figure 3:
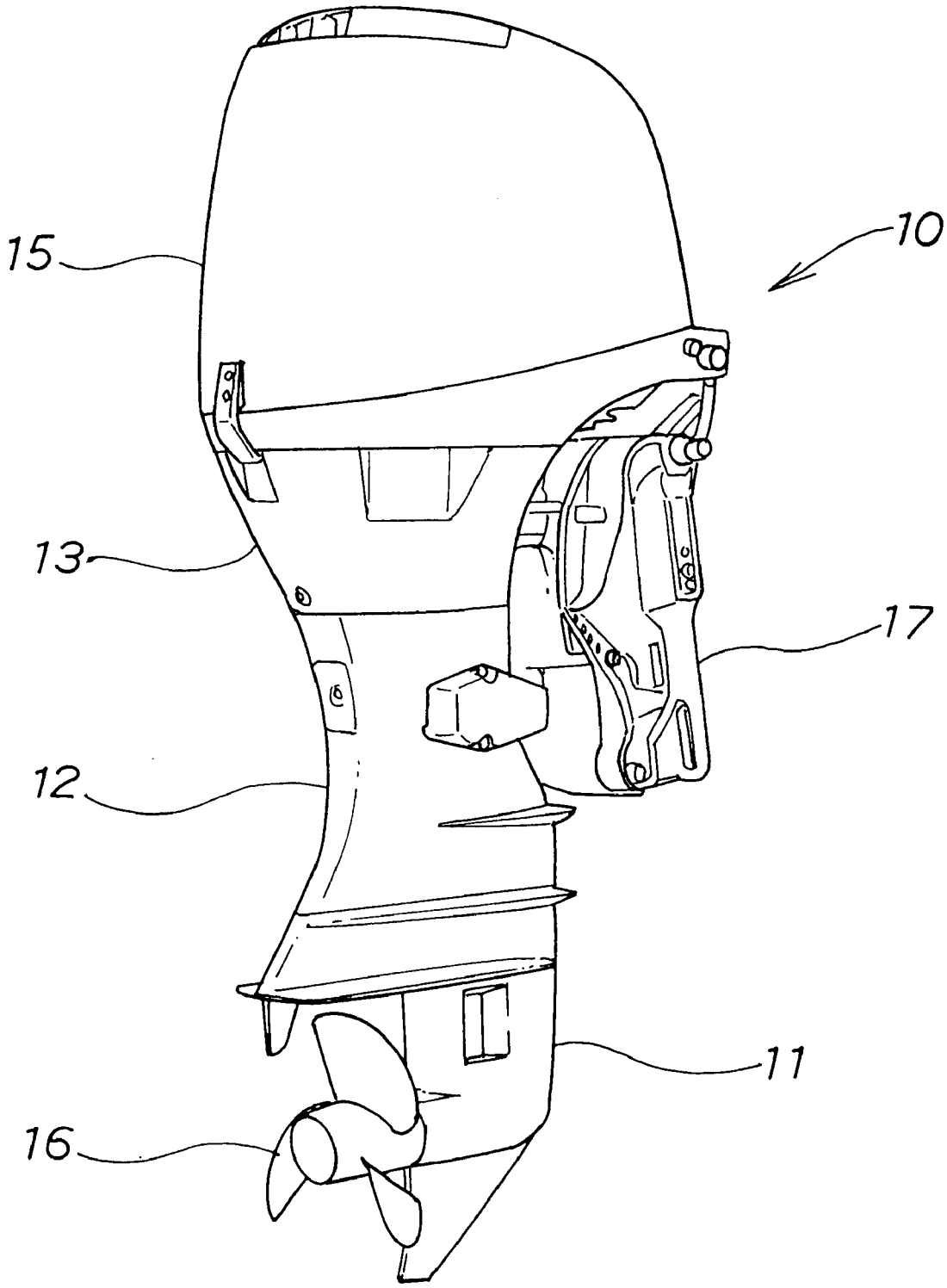
FIG. 3 is a perspective view of an exterior propeller for boats, to which the material of the invention is applied.

FIG. 3 is a perspective view of an exterior propeller for boats, to which the material of the invention is applied. In FIG. 3, the exterior propeller 10 comprises a gear case 11, an extension case 12, an undercover 13 and an engine cover 15 that are assembled as illustrated. To this is rotatably attached a screw 16 via an engine, a vertical shaft and a gear set (all not shown) covered by the engine cover 15. In the exterior propeller 10, the gear case 11 and the extension case 12 to be under the sea is specifically formed of the aluminum die-cast material for boats of the invention. The exterior propeller 10 is fitted to the stern (not shown) via the fixing bracket 17, in which the gear case 11 and the extension case 12 are specifically coated with paint.

In the manner as above, the aluminum die-cast material for boats of the invention is favorable for boat equipment generally required to have seawater corrosion resistance and mechanical strength, especially for interior and exterior propellers for boats, water-jet pumps and other members constituting a part of the bottom of boats.

EXAMPLES

Table 1 shows the components constituting an example of the invention and those constituting a comparative example.

TABLE 1

| | Chemical Components (wt. %) | | | | | | | | |
|---|---|---|---|---|---|---|---|---|---|
| | Cu | Si | Mg | Zn | Fe | Mn | Ni | Sn | Al |
| Inventive Example | At most 0.15 | 10.0 to 11.5 | 1.0 to 2.5 | At most 0.15 | 0.7 to 0.9 | 0.4 to 0.6 | at most 0.1 | at most 0.1 | balance |
| Comparative Example (ADC3) | At most 0.6 | 9.0 to 10.0 | 0.4 to 0.6 | At most 0.5 | at most 1.3 | at most 0.3 | at most 0.5 | at most 0.1 | balance |

A large number of samples were tested for tensile strength, and the data obtained fell in a range. Therefore, in the graph of FIG. 2, the tensile strength data of the samples tested are given not in lines but in zones that cover the data range.

Some samples were melted at 710° C. and cast, and the cast samples at 380° C. were taken out of the mold and left cooled in air. These were then tested for tensile strength, and their data are in the zone of "samples left cooled in air". The others were melted at 710° C. and cast, and the cast samples at 380° C. were taken out of the mold and quenched in water at 80° C. These were then tested for tensile strength, and their data are in the zone of "samples quenched in water". The process of quenching in water employed herein corresponds to steel quenching; and the process of cooling in air corresponds to steel normalizing.

The example is an aluminum die-cast material for boats of the invention, which comprises at most 0.15% by weight of Cu, from 10.0 to 11.5% by weight of Si, from 1.0 to 2.5% by weight of Mg, at most 0.15% by weight of Zn, from 0.7 to 0.9% by weight of Fe, from 0.4 to 0.6% by weight of Mn, at most 0.1% by weight of Ni and at most 0.1% by weight of Sn, with Al as the balance.

The comparative example is ADC3 defined in JIS H-5302 (1990) "Aluminum Alloy Die-Casts".

Concretely, the Cu content of the comparative example is at most 0.6% by weight, but that of the example is 0.15% by weight. The latter is reduced to be about ¼ of the former. The Mg content of the comparative example is from 0.4 to 0.6% by weight, but that of the example is from 1.0 to 2.5% by weight. The latter is increased to be about 2 to 4 times the former.

In Table 2 below, the mechanical properties of the material of the invention are compared with those of ADC3.

TABLE 2

| | Tensile Strength $N/mm^2$ | Proof Stress $N/mm^2$ | Elongation % | Remarks |
|---|---|---|---|---|
| Inventive Example | 289 | 132 | 7 | quenched |
| Comparative Example (ADC3) | 245 | 119 | 6.1 | sample |

The comparative example (ADC3) which is a popular aluminum alloy die-cast has a tensile strength of 245 $N/mm^2$, a proof stress of 119 $N/mm^2$ and an elongation of 6.1%; while the example of the invention has a tensile strength of 289 $N/mm^2$, a proof stress of 132 $N/mm^2$ and an elongation of 7%. Accordingly, all the mechanical properties of the example of the invention are better than those of the comparative example.

Regarding the corrosion resistance of the two, the Cu content of the comparative example is at most 0.6% by weight, while that of the example of the invention is at most 0.15% by weight, as in Table 1 above. Reducing the Cu content of these materials increases the corrosion resistance thereof, and it is obvious that the corrosion resistance of the example of the invention is much higher than that of the comparative example.

Regarding the fluidity of the two, the Si content of the comparative example is from 0.9 to 10.0% by weight, while that of the example of the invention is from 1.0 to 11.5% by weight, as in Table 1 above. Increasing the Si content of these materials improves the fluidity thereof, and it is obvious that the fluidity of the example of the invention is at least comparable to or higher than that of the comparative example.

Accordingly, the aluminum die-cast material for boats of the invention has good fluidity enough for die-casting, good corrosion resistance to seawater, and good mechanical strength enough for boat equipment, and its properties are all good and satisfactory.

In case where the products made of the material of the invention are coated with paint and baked, their hardness can be increased more.

As described hereinabove, the aluminum die-cast material for boats of the invention has good corrosion resistance to seawater as its Cu content, a factor to cause corrosion, is reduced to at most 0.15% by weight; it has good fluidity as its Si content, a factor to increase casting fluidity, is increased to fall between 10.0 and 11.5% by weight; and it has good mechanical properties as its Mg content, a factor to increase mechanical strength, is increased to fall between 0.4 and 0.6% by weight. Accordingly, the products of the invention are suitable to aluminum die-cast materials for boats that are required to have all good properties of high fluidity, good corrosion resistance and high mechanical strength.

What is claimed is:

1. An aluminum die-cast material for boats, consisting essentially of 0.15% by weight or less of Cu, 10.0 to 11.5% by weight of Si, 1.0 to 2.5% by weight of Mg, 0.15% by weight or less of Zn, 0.7 to 0.9% by weight of Fe, 0.4 to 0.6% by weight of Mn, 0.1% by weight or less of Ni, 0.1% by weight or less of Sn, and the balance of Al.

2. An aluminum die-cast material according to claim 1; wherein the material is cast in the form of a portion of a boat which is under water when the boat is afloat in the water.

3. An aluminum die-cast material according to claim 1; wherein the material is cast in the form of a portion of an outboard motor.

4. An aluminum die-cast material according to claim 3; wherein the material is cast in the form of a portion of an outboard motor which is under water when the motor is disposed in the water.

5. An aluminum die-cast material for use in the manufacture of boat components, comprising: 0.6% or less by weight of Cu, 10.0 to 11.5% by weight of Si, 1.0 to 2.5% by weight of Mg, 0.7 to 0.9% by weight of Fe, 0.4 to 0.6% by weight of Mn, and the balance Al.

6. An aluminum die-cast material according to claim 5; further comprising 0.15% or less by weight of Zn.

7. An aluminum die-cast material according to claim 5; further comprising 0.1% or less by weight of Ni.

8. An aluminum die-cast material according to claim 5; further comprising 0.1% or less by weight of Sn.

9. An aluminum die-cast material according to claim 5; wherein the material is cast in the form of a portion of a boat which is under water when the boat is afloat in the water.

10. An aluminum die-cast material according to claim 5; wherein the material is cast in the form of a portion of an outboard motor.

11. An aluminum die-cast material according to claim 10; wherein the material is cast in the form of a portion of an outboard motor which is under water when the motor is disposed in the water.

* * * * *